US007478039B2

(12) United States Patent
Stylianou et al.

(10) Patent No.: US 7,478,039 B2
(45) Date of Patent: Jan. 13, 2009

(54) STOCHASTIC MODELING OF SPECTRAL ADJUSTMENT FOR HIGH QUALITY PITCH MODIFICATION

(75) Inventors: Ioannis G Stylianou, Madison, NJ (US); Alexander Kain, Portland, OR (US)

(73) Assignee: AT&T Corp., New York, NY (US)

( * ) Notice: Subject to any disclaimer, the term of this patent is extended or adjusted under 35 U.S.C. 154(b) by 483 days.

(21) Appl. No.: 11/124,729

(22) Filed: May 9, 2005

(65) Prior Publication Data

US 2005/0203745 A1 Sep. 15, 2005

Related U.S. Application Data

(63) Continuation of application No. 09/769,112, filed on Jan. 25, 2001, now Pat. No. 6,910,007.

(60) Provisional application No. 60/208,374, filed on May 31, 2000.

(51) Int. Cl.
*G10L 11/04* (2006.01)

(52) U.S. Cl. ..... 704/207; 704/258

(58) Field of Classification Search ..... 704/207, 704/258

See application file for complete search history.

(56) References Cited

U.S. PATENT DOCUMENTS 5,473,728 A 12/1995 Luginbuhl et al.
5,675,702 A 10/1997 Gerson et al.
5,970,453 A 10/1999 Sharman
6,453,287 B1 9/2002 Unno et al.
6,470,312 B1 10/2002 Suzuki et al.

OTHER PUBLICATIONS

A.P. Dempster, N. M. Laird, D. B. Rubin, "Maximum Likelihood from Incomplete Data via the EM Algorithm", [Read before the Royal Statistical Society at a meeting organized by the Research Section on Wed., Dec. 8, 1976].

Y. Stylianou, "Applying the Harmonic Plus Noise Model in Concatenative Speech Synthesis", IEEE Trans. on Speech and Audio Processing, vol. 9, No. 1, Jan. 2001.

*Primary Examiner*—David R Hudspeth
*Assistant Examiner*—Jakieda R Jackson
(74) *Attorney, Agent, or Firm*—Henry Brendzel

(57) ABSTRACT

Natural-sounding synthesized speech is obtained from pieced elemental speech units that have their super-class identities known (e.g. phoneme type), and their line spectral frequencies (LSF) set in accordance with a correlation between the desired fundamental frequency and the LSF vectors that are known for different classes in the super-class. The correlation between a fundamental frequency in a class and the corresponding LSF is obtained by, for example, analyzing the database of recorded speech of a person and, more particularly, by analyzing frames of the speech signal.

15 Claims, 1 Drawing Sheet

STOCHASTIC MODELING OF SPECTRAL ADJUSTMENT FOR HIGH QUALITY PITCH MODIFICATION

RELATED APPLICATIONS

This is a continuation of U.S. patent application Ser. No. 09/769,112, filed Jan. 25, 2001, now U.S. Pat. No. 6,910,007, which application claims priority from provisional application 60/208,374 filed on May 31, 2000.

BACKGROUND OF THE INVENTION

This invention relates to speech and, more particularly, to a technique that enables the modification of a speech signal so as to enhance the naturalness of speech sounds generated from the signal.

Concatenative text-to-speech synthesizers, for example, generate speech by piecing together small units of speech from a recorded-speech database and processing the pieced units to smooth the concatenation boundaries and to match the desired prosodic targets (e.g. speaking speed and pitch contour) accurately. These speech units may be phonemes, half phones, di-phones, etc. One of the more important processing steps that are taken by prior art systems, in order to enhance naturalness of the speech, is modification of pitch (i.e., the fundamental frequency, $F_0$) of the concatenated units, where pitch modification is defined as the altering of $F_0$. Typically, the prior art systems do no not modify the magnitude spectrum of the signal. However, it has been observed that large modification factors for $F_0$ lead to a perceptible decrease in speech quality, and it has been shown that at least one of the reasons for this degradation is the assumption by these prior art system that the magnitude spectrum can remain unaltered. In particular, T. Hirahara has shown in "On the Role of Fundamental Frequency in Vowel Perception," *The Second Joint Meeting of ASA and ASJ*, November 1988, that an increase of $F_0$ was observed to cause a vowel boundary shift or a vowel height change. Also, in "Vowel F1 as a Function of Speaker Fundamental Frequency," 110$^{th}$ *Meeting of JASA*, vol. 78, Fall 1985, A. K. Syrdal and S. A. Steele showed that speakers generally increase the first formant as they increase $F_0$. These results clearly suggest that the magnitude spectrum must be altered during pitch modification. Recognizing this need, K. Tanaka and M. Abe suggested, in "A New fundamental frequency modification algorithm with transformation of spectrum envelope according to $F_0$," *ICASSP* vol. 2, pp. 951-954, 1997, that the spectrum should be modified by a stretched difference vector of a codebook mapping. A shortcoming of this method is that only three ranges of $F_0$ (high, middle, and low) are encoded. A smoother evolution of the magnitude spectrum (of an actual speech signal), or the spectrum envelope (of a synthesized speech signal), as a function of changing $F_0$ is desirable.

SUMMARY

An advance in the art is achieved with an approach where synthesized speech is obtained from pieced elemental speech units that have their super-class identities known (e.g. phoneme type), and their line spectral frequencies (LSF) set in accordance with a correlation between the desired fundamental frequency and the LSF vectors that are known for different classes in the super-class. The correlation between a fundamental frequency in a class and the corresponding LSF is obtained by, for example, analyzing the database of recorded speech of a person and, more particularly, by analyzing frames of the speech signal. In one illustrative embodiment, a text-to-speech synthesis system concatenates frame groupings that belong to specified phonemes, the phonemes are conventionally modified for smooth transitions, the concatenated frames have their prosodic attributes modified to make the synthesized text sound natural—including the fundamental frequency. The spectrum envelop of modified signal is then altered based on the correlation between the modified fundamental frequency in each frame and LSFs.

BRIEF DESCRIPTION OF THE DRAWING

FIG. 1 presents an illustrative example of a system in accord with the principles disclosed herein and.

DETAILED DESCRIPTION

Figure 1:
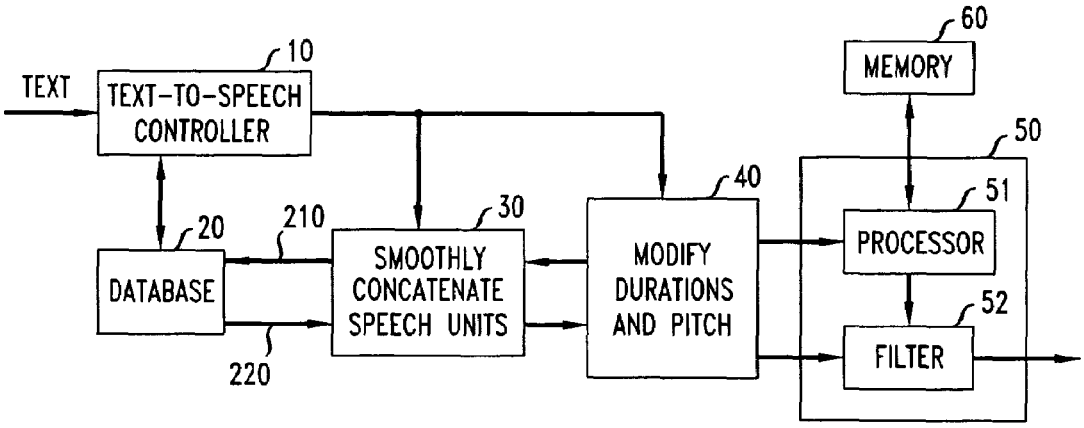

FIG. 1 presents one illustrative embodiment of a system that benefits from the principles disclosed herein. It is a voice synthesis system; for example, a text-to-speech synthesis system. It includes a controller 10 that accepts text and identifies the sounds (i.e., the speech units) that need to be produced, as well as the prosodic attributes of the sounds; such as pitch, duration and energy of the sounds. The construction of controller 10 is well known to persons skilled in the text-to-speech synthesis art.

To proceed with the synthesis, controller 10 accesses database 20 that contains the speech units, retrieves the necessary speech units, and applies them to concatenation element 30, which is a conventional speech synthesis element. Element 30 concatenates the received speech units, making sure that the concatenations are smooth, and applies the result to element 40. Element 40, which is also a conventional speech synthesis element, operates on the applied concatenated speech signal to modify the pitch, duration and energy of the speech elements in the concatenated speech signal, resulting in a signal with modified prosodic values.

It is at this point that the principles disclosed herein come into play, where the focus is on the fact that the pitch is modified. Specifically, the output of element 40 is applied to element 50 that, with the aid of information stored in memory 60, modifies the magnitude spectrum of the speech signal.

As indicated above, database 20 contains speech units that are used in the synthesis process. It is useful, however, for database 20 to also contain annotative information that characterizes those speech units, and that information is retrieved concurrently with the associated speech units and applied to elements 30 et seq. as described below. To that end, information about the speech of a selected speaker is recorded during a pre-synthesis process, is subdivided into small speech segments, for example phonemes (which may be on the order of 150 msec), is analyzed, and stored in a relational database table. Illustratively, the table might contain the fields:

Record ID,
phoneme label,
average $F_0$,
duration.

To obtain characteristics of the speaker with finer granularity, it is useful to also subdivide the information into frames, for example, 10 msec long, and to store frame information together with frame-annotation information. For example, a second table of database 20 may contain the fields:

Record ID,
parent Phoneme record ID,
$F_o$, speech samples of the frame.

line spectral frequencies (LSF) vector of the speech samples, linear prediction coefficients (LPC) vector of the speech samples.

It may be noted that the practitioner has fair latitude as to what specific annotative information is developed for storage in database 20, and the above fields are merely illustrative. For example the LPC can be computed "on the fly" from the LSFs, but when storage is plentiful, one might wish to store the LPC vectors.

Once the speech information of the recorded speaker is analyzed and stored in database 20, in the course of a synthesis process controller 10 can specify to database 20 a particular phoneme type with a particular average pitch and duration, identify a record ID that most closely fulfills the search specification, and then access the second database to obtain the speech samples of all of the frames that correspond to the identified record ID, in the correct sequence. That is, database 20 outputs to element 30 a sequence of speech sample segments. Each segment corresponds to a selected phoneme, and it comprises plurality of frames or, more particularly, it contains the speech samples of the frames that make up the phoneme. It is expected that, as a general proposition, the database will have the desired phoneme type but will not have the precise average $F_0$ and/or duration that is requested. Element 30 concatenates the phonemes under direction of controller 10 and outputs a train of speech samples that represent the combination of the phonemes retrieved from database 20, smoothly combined. This train of speech samples is applied to element 40, where the prosodic values are modified, and in particular where $F_0$ is modified. The modified signal is applied to element 50, which modifies the magnitude spectrum of the speech signal in accord with the principles disclosed herein.

As indicated above, research suggests that the spectral envelope modifications that element 40 needs to perform are related to the changes that are effected in $F_0$; hence, one should expect to find a correlation between the spectral envelope and $F_0$. To learn about this correlation, one can investigate different parameters that are related to the spectral envelope, such as the linear predictive codes (LPCs), or the line spectral frequencies (LSFs). We chose to use bark-scale warped LSFs because of their good interpolation and coding properties, as demonstrated by K. K. Paliwal, in "Interpolation Properties of Linear Prediction Parametric Representations," Proceedings of EUROSPEECH, pp. 1029-32, September 1995. Additionally, the bark-scale warping effects a frequency weighting that is in agreement with human perception.

In consonance with the decision to use LSFs in seeking a method for estimating the necessary evolution of a spectral envelope with changes to $F_0$, we chose to look at the frame records of database 20 and, in particular, at the correlation between the $F_0$'s and the LSFs vectors of those records. Through statistical analysis of this information we have determined that, indeed, there are significant correlations between $F_0$ and LSFs. We have also determined that these correlations are not uniform but, rather, dissimilar even within a set of records that correspond to a given phoneme. Still further, we determined that useful correlation is found when each phoneme is considered to contain Q speech classes.

In accordance with the principles disclosed herein, therefore, the statistical dependency of $F_0$ and LSFs is modeled using a Gaussian Mixture Model (GMM), which models the probability distribution of a statistical variable z that is related to both the $F_0$ and LSFs as the sum of Q multivariate Gaussian functions, $$p(z) = \sum_{i=1}^{Q} \alpha_i N(z, \mu_i, \Sigma_i) \tag{1}$$

where $N(z, \mu_i, \Sigma_i)$ is a normal distribution with mean vector $\mu_i$ and covariance matrix $\Sigma_i$, $\alpha_i$ is the prior probability of class i, such that $$\sum_{i=1}^{Q} \alpha_i = 1$$

and $\alpha_i \geqq 0$, and z, for example, is $[F_0, \text{LSFs}]^T$. Specifically, employing a conventional Expectation Maximization (EM) algorithm to which the value of Q is applied, as well as the $F_0$ and LSFs vectors of all frame sub-records in database 20 that correspond to a particular phoneme type, yields the $\alpha_i$, $\mu_i$, and $\Sigma_i$, parameters for the Q classes of that phoneme type. Those parameters, which are developed prior to the synthesis process, for example by processor 51, are stored in memory 60 under control of processor 51.

With the information thus developed from the information in database 20, one can then investigate whether, for a particular phoneme label and a particular $F_0$, e.g., $F_{desired}$, the appropriate corresponding LSF vector, $\text{LSF}_{desired}$, can be estimated with the aid of the statistical information stored in memory 60.

More specifically, for a particular speech class, if $x=\{x_1, x_2, \ldots, x_N\}$ is the collection of $F_0$'s and $y=\{y_1, y_2, \ldots, y_N\}$ is the corresponding collection of LSF vectors, the question is whether a mapping $\Im$ can be found that minimizes the mean squared error $$\epsilon_{min} = E[\|y - \Im(x)\|^2] \tag{2}$$

where E denotes expectation. To model the joint density, x and y are joined to form $$z = \begin{bmatrix} x \\ y \end{bmatrix} \tag{3}$$

and the GMM parameters $\alpha_i$, $\mu_i$ and $\Sigma_i$, are estimated as described above in connection with equation (1).

Based on various considerations it was deemed advisable to select the mapping function $\Im$ to be $$\begin{aligned} \mathcal{F}(x) &= E[y \mid x] \\ &= \sum_{i=1}^{Q} h_i(x) \cdot [\mu_i^y + (\Sigma_i^{yx})(\Sigma_i^{xx})^{-1}(x - \mu_i^x)] \text{ where} \end{aligned} \tag{4}$$

$$h_i = \frac{\alpha_i N(x, \mu_i^x, \Sigma_i^{xx})}{\sum_{j=1}^{Q} \alpha_j N(x, \mu_j^x, \Sigma_j^{xx})}, \tag{5}$$

-continued $$\Sigma_i = \begin{bmatrix} \Sigma_i^{xx} & \Sigma_i^{xy} \\ \Sigma_i^{yx} & \Sigma_i^{yy} \end{bmatrix}, \text{ and} \tag{6}$$

$$\mu_i = \begin{bmatrix} \mu_i^x \\ \mu_i^y \end{bmatrix}. \tag{7}$$

From the above, it can be seen that once the $\alpha_i$, $\mu_i$ and $\Sigma_i$, parameters are known for a given phoneme type (from the EM algorithm), equation (6) yields $\Sigma_i^{xx}$ $\Sigma_i^{xy}$ $\Sigma_i^{yx}$ and $\Sigma_i^{yy}$, and equation (7) yields $\mu_i^x$ and $\mu_i^y$. From this information, the parameter $h_i$ is evaluated in accordance with equation (5), allowing a practitioner to estimate the LSF vector, $LSF_{desired}$, by evaluating $\Im(x)$, for $x=F_{desired}$, in accordance with equation (4); i.e., $LSF_{desired} \cong \Im(F_{desired})$.

In the FIG. 1 system described above, one input to element 50 is the train of speech samples from element 40 that represent the concatenated speech. This concatenated speech, it may be remembered, was derived from frames of speech samples that database 20 provided. In synchronism with the frames that database 20 outputs, it also outputs the phoneme label that corresponds to the parent phoneme record ID of the frames that are being outputted, as well as the LPC vector coefficients. That is, the speech samples are outputted on line 210, while the phoneme labels and the LPC coefficients are outputted on line 220. The phoneme labels track the associated speech sample frames through elements 30 and 40, and are thus applied to element 50 together with the associated (modified) speech sample frames of the phoneme (or at least with the first frame of the phoneme). The associated LPC coefficients are also applied to element 50 together with the associated (modified) speech sample frames of the phoneme. The speech samples are applied within element 50 to filter 52, while the phoneme labels and the LPC coefficients are applied within element 50 to processor 51. Based on the phoneme label, in accord with the principles disclosed above, processor 51 obtains the $LSF_{desired}$ of that phoneme. To modify the magnitude spectrum for each voiced phoneme frame in this train of samples in accordance with the $LSF_{desired}$ of that phoneme frame, processor 51 within element 50 develops LPC coefficients that correspond to $LSF_{desired}$ in accordance with well-known techniques.

Filter 52 is a digital filter whose coefficients are set by processor 51. The output of the filter is the spectrum-modified speech signal. We chose a transfer function for filter 52 to be $$\frac{1 - \sum_{i=1}^{p} a_i z^{-i}}{1 - \sum_{i=1}^{p} b_i z^{-i}}, \tag{8}$$

where the $a_i$'s are the LPC coefficients applied to element 50 from database 20 (via elements 30 and 40), and the $b_i$'s are the LPC coefficients computed within processor 51. This yields a good result because the magnitude spectrum of the signal at the input to element 50 is approximately equal to the spectrum envelope as represented the LPC vector that is stored in database 20, that is, the magnitude spectrum is equal to $$\frac{1}{1 - \sum_{i=1}^{p} a_i z^{-i}},$$

plus some small error. Of course, other transfer functions can also be employed.

Actually, if desired, the speech samples stored in database 20 need not be employed at all in the synthesis process. That is, an arrangement can be employed where speech is coded to yield a sequence of tuples, each of which includes an $F_0$ value, duration, energy, and phoneme class. This rather small amount of information can then be communicated to a receiver (e.g. in a cellular environment), and the receiver synthesizes the speech. In such a receiver, elements 10, 30, and 40 degenerate into a front end receiver element 15 that. applies a synthesis list of the above-described tuples to element 50. Based on the desired phoneme and phoneme class, appropriate $\alpha_i$, $\mu_i$ and $\Sigma_1$ data is retrieved from memory 60, and based on the desired $F_0$ the $LSF_{desired}$ vectors are generated as described above. From the available $LSF_{desired}$ vectors, LPC coefficients are computed, and a spectrum having the correct envelope is generated from the LPC coefficient. That spectrum is multiplied by sequences of pulses that are created based on the desired $F_0$, duration, and energy, yielding the synthesized speech. In other words, a minimal receiver embodiment that employs the principles disclosed herein comprises a memory 60 that stores the information disclosed above, a processor 51 that is responsive to an incoming sequence of list entries, and a spectrum generator element 53 that generates a train of pulses of the required repetition rate ($F_0$) with a spectrum envelope corresponding to $$\frac{1}{1 - \sum_{i=1}^{p} b_i z^{-i}}$$

where $b_i$'s are the LPC coefficients computed within processor 51.

Figure 2:
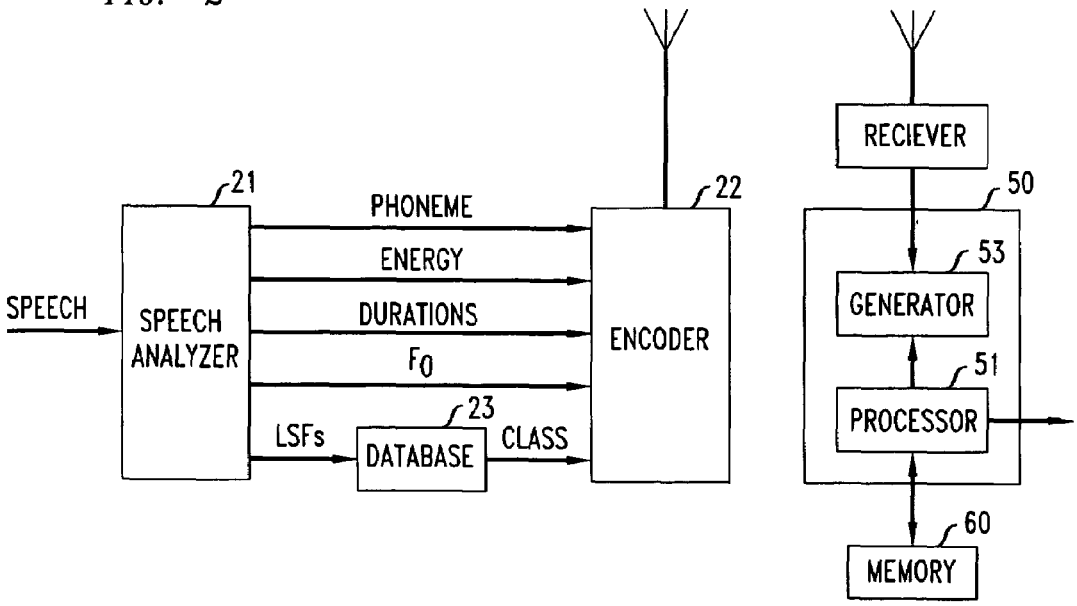
FIG. 2 depicts a minimal transmitter embodiment and a corresponding minimal receiver embodiment.

This is illustrated in FIG. 2.

The minimal transmitter embodiment for communicating actual (as contrasted to synthesized) speech comprises a speech analyzer 21 that breaks up an incoming speech signal into phonemes, and frames, and for each frame it develops tuples that specify phoneme type, $F_0$, duration, energy, and LSF vectors. The information corresponding to $F_0$ and the LSF vectors is applied to database 23, which identifies the phoneme class. That information is combined with the phoneme type, $F_0$, duration, and energy information in encoder 22, and transmitted to the receiver.

The above-disclosed technique applies to voiced phonemes. When the phonemes are known, as in the above-disclosed example, we call this mode of operation "supervised." In the supervised mode, we have employed 27 phoneme types in database 20, and we used a value of 6 for Q. That is, in ascertaining the parameters $\alpha_i$, $\mu_i$ and $\Sigma_i$, the entire collection of frames that corresponded to a particular phoneme type was considered to be divisible into 6 classes.

At times, the phonemes are not known a priori, or the practitioner has little confidence in the ability to properly divide the recorded speech into known phoneme types. In accordance with the principles disclosed herein, that is not a dispositive failing. We call such mode of operation "unsupervised." In such mode of operation we scale up the notion of classes. That is, without knowing the phoneme to which frames belong, we assume that the entire set of frames in database 20 forms a universe that can be divided into classes, for example 32 super-classes, or 64 super-classes, where z, for example, is $[LSFS]^T$, and the EM algorithm is applied to the entire set of frames. Each frame is thus assigned to a super-class, and thereafter, each super-class is divided as described above, into Q classes, as described above.

The above discloses the principles of this invention through, inter alia, descriptions of illustrative embodiments. It should be understood, however, that various other embodiments are possible, and various modifications and improvements are possible without departing from the spirit and scope of this invention. For example, a processor 51 is described that computes the $LSF_{desired}$ based on a priori computed parameters $\alpha_i$, $\mu_i$ and $\Sigma_i$, pursuant to equations (4)-(7). One can create an embodiment, however, where the $LSF_{desired}$ vectors can also be computed beforehand, and stored in memory 60. In such an embodiment, processor 51 needs to only access the memory rather than perform significant computations.

The invention claimed is:

1. Apparatus comprising:

a database that contains a collection of information relative to speech units;

a concatenator responsive to information provided by said database for smoothly concatenating the provided information to thereby develop synthesized speech;

a signal modifier responsive to said synthesized speech for modifying pitch, duration and energy of the speech units contained in the synthesized speech;

a controller adapted to receive a stream of desired speech units, cause said database to provide to the concatenator selected database signals from said collection of information, which signals pertain to speech units that most closely approximate the desired speech units, and cause the signal modifier to modify the pitches of the speech units in the synthesized speech to correspond to the pitches of the desired speech units, to thereby form a pitch-modified synthesized speech; and a spectrum magnitude processor responsive to information provided by said signal modifier for developing spectral envelope parameters of the pitch-modified synthesized speech based on the pitches of the desired speech units, class labels associated with the respective speech units provided by said database, and statistical information that correlates spectral envelope parameters to pitch frequencies and speech class.

2. The apparatus of claim 1 where construction of said controller for receiving said stream of desired speech units includes capability to receive a speech specification and to convert said specification into said stream of desired speech units.

3. The apparatus of claim 2 where said speech specification is text.

4. The apparatus of claim 1 where said desired speech units are desired phonemes, and said collection of speech units within said database comprises a first table that stores records of phonemes with associated (a) phoneme label, (b) average pitch frequency, and (c) duration.

5. The apparatus of claim 4 where said phoneme label associated with each phoneme is a class label.

6. The apparatus of claim 4 further comprising a second table within said database that stores a set of frames associated with each of the phoneme records in the first table, where each frame record includes a pitch frequency, a plurality of speech samples, spectrum envelope parameters, and a reference to the record's associated phoneme.

7. The apparatus of claim 6 where said envelope parameters comprise Linear Prediction Coefficients (LPC).

8. The apparatus of claim 6 where said envelope parameters comprises Linear Spectral Frequencies (LSF).

9. The apparatus of claim 7 where said selected database signals associated with each desired phoneme comprise:

a selected phoneme's record; and said set of frame records associated with the selected phoneme.

10. The apparatus of claim 9 where said developing of spectral envelope parameters comprises developing LSF parameters for each record of the pitch-modified synthesized speech with aid of said statistical information and developing LPC coefficients from the developed LSF parameters.

11. The apparatus of claim 10 where said spectrum magnitude processor includes a filter responsive to said pitch-modified synthesized speech applying a transfer function that is related to said LPC coefficients provided by said database and to said LPC coefficients developed from with aid of said statistical information.

12. The apparatus of claim 11 where said transfer function is $$\frac{1-\sum_{i=1}^{p} a_i z^{-i}}{1-\sum_{i=1}^{p} b_i z^{-i}},$$

where the $a_i$'s are said LPC coefficients provided by said database, and the $b_i$'s are said LPC coefficients developed from with air of said statistical information.

13. The apparatus of claim 9 where class label associated with the speech units provided by said database that is employed by said spectrum magnitude processor is the phoneme label provided by said database associated with each selected phoneme.

14. The apparatus of claim 1 further comprising a wireless receiver through which said speech specification is received.

15. The apparatus of claim 14 further comprising means to make said apparatus a cell phone.

* * * * *